US005636746A

United States Patent [19]

McQueeny

[11] Patent Number: 5,636,746

[45] Date of Patent: Jun. 10, 1997

[54] COMPUTER ACCESSORY DISPLAY PACKAGE

[75] Inventor: Thomas P. McQueeny, Chicago, Ill.

[73] Assignee: R. R. Donnelley & Sons Company, Chicago, Ill.

[21] Appl. No.: 513,323

[22] Filed: Aug. 10, 1995

[51] Int. Cl.[6] ..... B65D 25/00

[52] U.S. Cl. ..... 206/756; 206/746; 206/765; 206/769; 206/778

[58] Field of Search ..... 206/740, 741, 206/746, 756, 765, 769, 776, 778, 320, 524.9; 229/120.25, 120.26

[56] References Cited

U.S. PATENT DOCUMENTS

| | | | |
|---|---|---|---|
| 1,367,048 | 2/1921 | Horr . | |
| 1,949,376 | 2/1934 | Mansfield et al. | 206/765 |
| 2,300,411 | 11/1942 | Dubey | 206/44 |
| 2,518,779 | 8/1950 | Mennessey | 206/740 |
| 2,960,149 | 11/1960 | Throssel | 155/131 |
| 3,159,273 | 12/1964 | Schecterson et al. | 206/45.19 |
| 3,231,077 | 1/1966 | Grimm | 206/45.33 |
| 3,254,759 | 6/1966 | Britton | 206/756 |
| 3,308,934 | 3/1967 | Reiner | 206/740 |
| 4,244,509 | 1/1981 | Dlugopolski | 229/36 |
| 4,304,328 | 12/1981 | Pilat | 206/45.19 |
| 4,320,839 | 3/1982 | Skaggs | 206/591 |
| 4,667,819 | 5/1987 | Lu | 206/312 |
| 4,709,812 | 12/1987 | Kosterka | 206/310 |
| 5,029,702 | 7/1991 | Tong | 206/315.1 |
| 5,076,432 | 12/1991 | Wolf et al. | 206/449 |
| 5,085,318 | 2/1992 | Leverick | 206/312 |
| 5,088,599 | 2/1992 | Mahler | 206/313 |
| 5,101,973 | 4/1992 | Martinez | 206/312 |
| 5,154,284 | 10/1992 | Starkey | 206/311 |
| 5,186,319 | 2/1993 | Ting | 206/45.14 |
| 5,186,327 | 2/1993 | McCafferty et al. | 206/313 |
| 5,188,229 | 2/1993 | Bernstein | 206/312 |
| 5,242,049 | 9/1993 | Mizuno et al. | 206/313 |
| 5,248,032 | 9/1993 | Sheu et al. | 206/312 |
| 5,289,916 | 3/1994 | Mickelberg | 206/45.34 |
| 5,289,918 | 3/1994 | Dobias et al. | 206/312 |
| 5,419,433 | 5/1995 | Harrer et al. | 206/313 |
| 5,529,174 | 6/1996 | McQueeny | 206/320 |

*Primary Examiner*—David T. Fidei
*Attorney, Agent, or Firm*—Marshall, O'Toole, Gerstein, Murray & Borun

[57] ABSTRACT

A package for the display of a plurality of different types of computer accessories is provided with a container having a bottom portion, a back wall, a top portion, and a pair of side walls, all of which define a partially enclosed space. The container has a unitary support structure disposed therein for supporting a plurality of computer accessories. The unitary support structure includes a first support structure adapted to support a first type of computer accessory, a second support structure adapted to support a second type of computer accessory, and a third support structure adapted to support a third type of computer accessory, the shapes and/or sizes of the computer accessories being different from each other.

20 Claims, 4 Drawing Sheets

COMPUTER ACCESSORY DISPLAY PACKAGE

BACKGROUND OF THE INVENTION

The present invention relates to a display package for the display of a number of different types of products or product accessories.

Various types of packages have been used in the past to present products for display. For example, Dubey U.S. Pat. No. 2,300,411 discloses a merchandising and display box having a bottom portion, a back wall, two triangularly shaped side walls, and a front portion which is angularly sloped. The front portion of the display box is subdivided, via a number of longitudinally extending dividers, into a number of substantially identical, longitudinally extending pockets in which small articles, such as bars of chewing gum, may be displayed.

Grimm U.S. Pat. No. 3,231,077 discloses a display carton for the packaging and display of items such as toys. The Grimm carton has a bottom portion, a top portion, a back wall with a window formed therein, and two side walls which are trapezoidally shaped, all of which define a partially enclosed space having an angled front open area which is enclosed by a transparent film.

Ting U.S. Pat. No. 5,186,319 discloses a transport and display case for an animal figurine. The case has two trapezoidally shaped side walls and four remaining walls which define an enclosed space in which the figurine is disposed. The case has a front angularly disposed wall in which a generally circular aperture is formed, via a number of radially disposed slits, so that the head of the animal figurine may extend through the circular aperture.

SUMMARY OF THE INVENTION

The invention is directed to a package for the display of a plurality of different types of products or product accessories such as computer accessories. The display package is provided with a container having a bottom portion, a back wall, a top portion, and a pair of side walls, all of which define a partially enclosed space. The container has an internal support structure disposed therein for supporting a plurality of computer accessories. The internal support structure includes a first support structure adapted to support a first type of computer accessory, a second support structure adapted to support a second type of computer accessory, and a third support structure adapted to support a third type of computer accessory, the shapes and/or sizes of the computer accessories being different from each other. The display package may be provided with a transparent overlay which fully encloses the partially enclosed space.

The first support structure may be a hexahedral cavity adapted to support a computer mouse, the second support structure may be a pair of parallel slots adapted to support a computer disk holder, and the third support structure may be a pair of angled walls adapted to support a computer keyboard.

The internal support structure may have a central portion adapted to support a first type of product or product accessory with a first shape and/or size and at least one side portion integrally formed with the central portion, the side portion being adapted to support a second type of product or product accessory having a shape and/or size different from that of the first type of product or product accessory.

These and other features and advantages of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
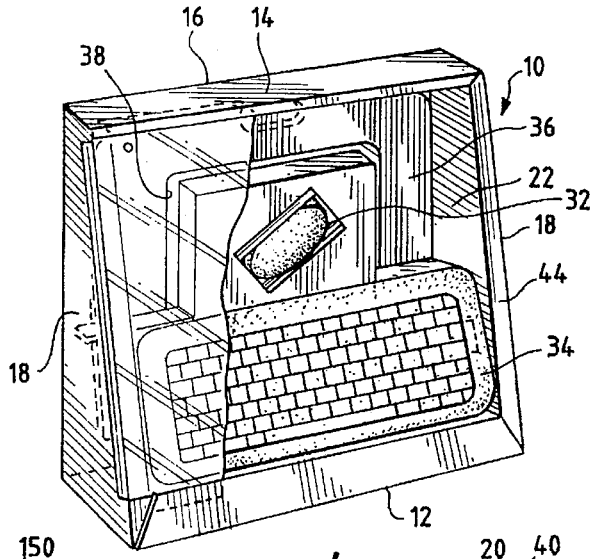
FIG. 1 is a perspective view of a preferred embodiment of a display package in accordance with the invention with a number of computer accessories disposed therein.
Figure 3:
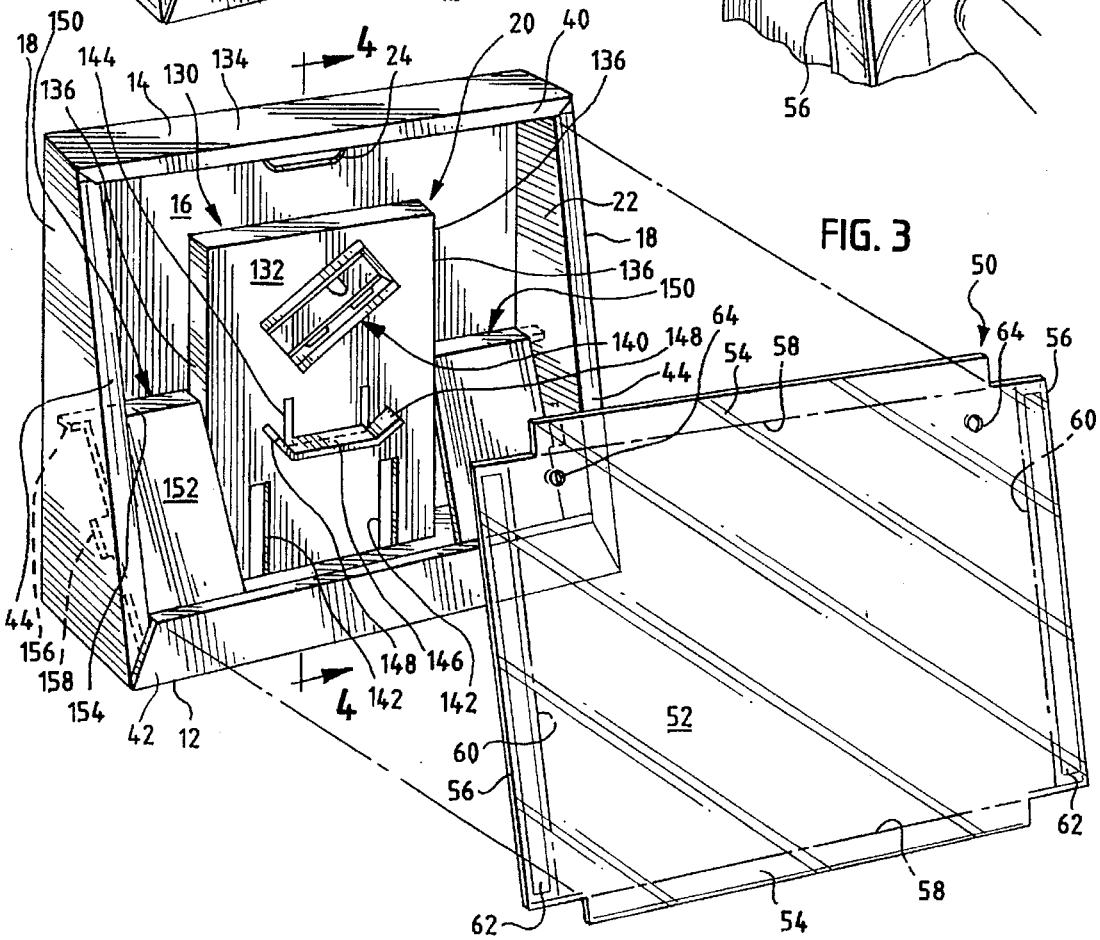
FIG. 3 illustrates the display package without the computer accessories shown therein.

A preferred embodiment of a computer accessory display package 10 is illustrated in the figures. Referring to FIGS. 1 and 3, the display package 10 has a bottom face 12, a top face 14, a back wall 16, and a pair of trapezoidally shaped side walls 18, all of which define a partially enclosed space within the interior of the display package 10 within which a number of computer accessories are supported by a unitary internal support structure 20. The display package 10 has a pair of internal side walls 22 that are shaped to correspond to the trapezoidal side walls 18. The back wall 16 has an oval slot 24 formed therein to facilitate carrying the display package 10.

As shown in FIG. 1, the computer accessories may include a computer mouse 32 which may be electronically coupled to a computer for moving a cursor on the CRT monitor of the computer, a keyboard 34, and a computer monitor mask 36 in the form of a rectangular border disposed about a central rectangular aperture 38, the aperture 38 being sized to match the display area of the CRT monitor. The display package 10 may include other computer accessories (not shown), such as a mouse pad and a holder for computer disks. The disk holder may be U-shaped and have a generally flat horizontal tray portion and two vertically extending arms (analogous to a pair of bookends) which are adapted to retain a number of computer disks in an upright position. The vertical arms of the disk holder may be horizontally movable or adjustable along the horizontal tray portion so as to store a variable number of disks.

Referring to FIG. 3, each of the sidewalls 18 is trapezoidally shaped, having a non-constant width which uniformly decreases from a relatively large width which is the same as the width of the bottom face 12 to a relatively small width which is the same as the width of the top face 14. Due to the trapezoidally shaped side walls 18, the display package 10 has a front face which is angled with respect to the vertical. The front face is composed of four faces, including an upper face 40, a lower face 42, and two side faces 44.

Figure 2:
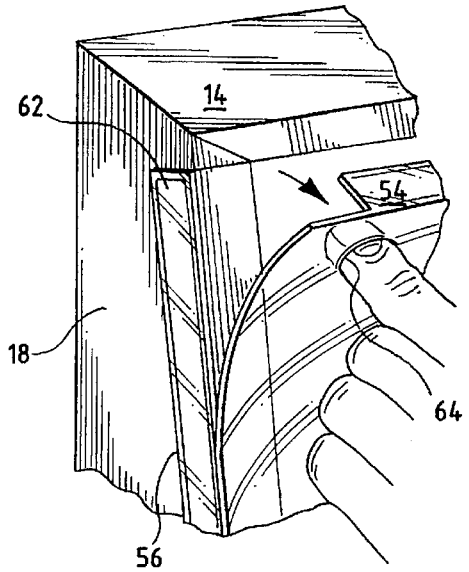
FIG. 2 is a perspective view of a portion of the display package.

A transparent sheet or overlay 50 is disposed over the front face of the display package 10 to fully enclose the internal space in which the computer accessories are disposed. The overlay 50 has a central rectangular portion 52, a pair of upper and lower tabs 54, and a pair of side tabs 56. As shown in FIG. 2, when the transparent overlay 50 is fixed to the display package 10, the tabs 54 are folded perpendicularly to the central portion 52 along a pair of dotted lines 58 shown in FIG. 3, and the tabs 56 are folded perpendicularly to the central portion 52 along a pair of dotted lines 60 shown in FIG. 3. An adhesive strip 62 is disposed on each of the side tabs 56 to bond them to the side walls 18 of the display package 10. A removable non-adhesive strip may be disposed over the adhesive strip 62 to facilitate ease of assembly of the display package 10. The overlay 50 has a pair of holes 64 sized to accommodate a person's finger, as shown in FIG. 2.

Figure 5:
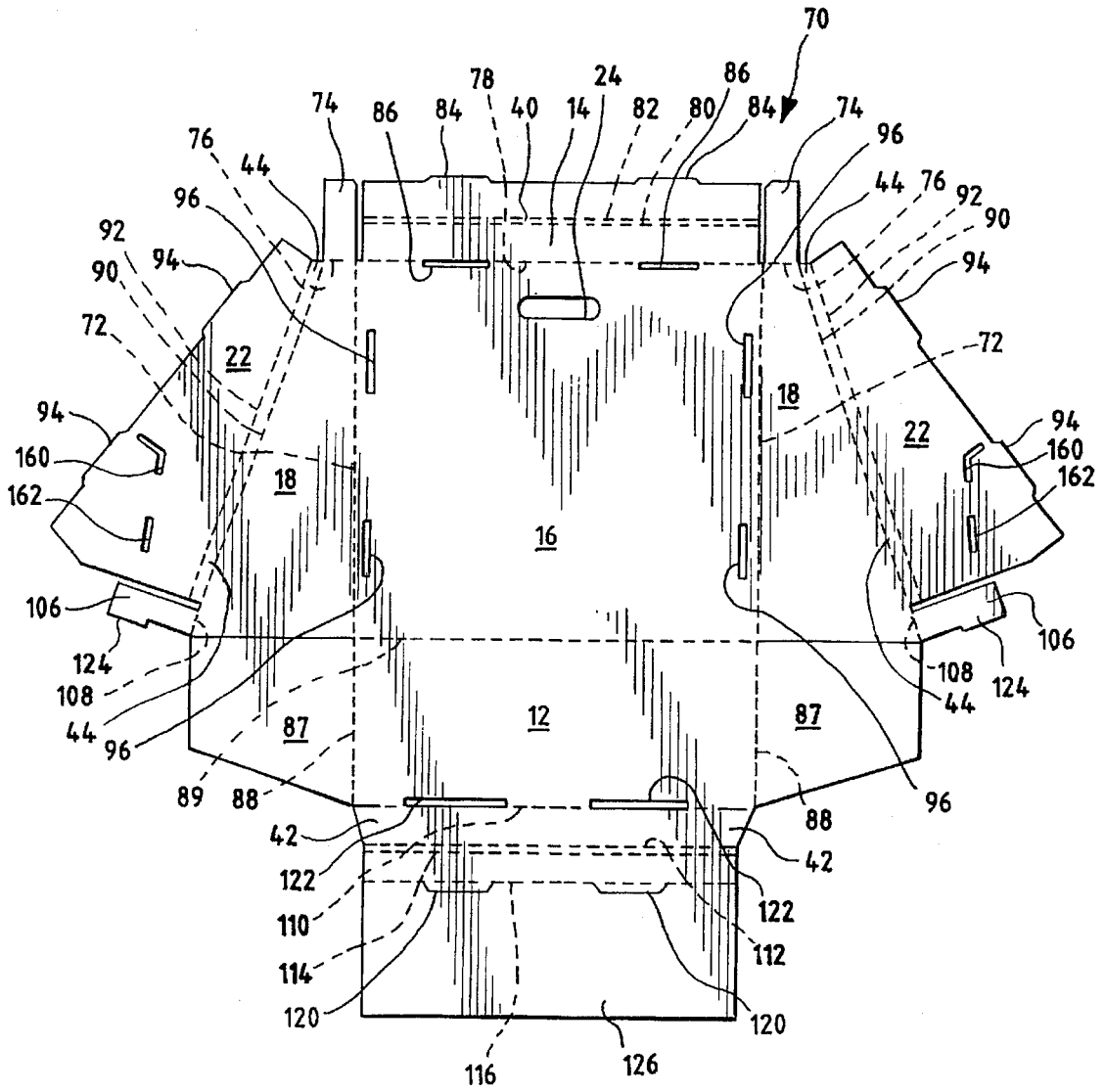
FIG. 5 illustrates a cardboard blank from which the display package may be formed.

The exterior portion of the display package 10 may be formed from a single sheet 70 of material, such as double-faced corrugated cardboard, shown in FIG. 5, in which fold lines are indicated by dotted lines and boundaries or cuts are indicated by solid lines. Referring to FIG. 5, to form the exterior portion of the display package 10, the sheet 70 is first folded along a pair of vertical fold lines 72 so that the side walls 18 are perpendicular to the back wall 16. Then, a pair of tabs 74 are folded inwardly along a pair of fold lines 76 until the tabs 74 are parallel to a fold line 78. Then, the top of the sheet 70 is folded over the tabs 74 by making successive folds along three fold lines 78, 80, 82, and a pair of tabs 84 are forced into a pair of slots 86, thus maintaining the side walls 18 in a position perpendicular to the back wall 16.

Next, a pair of flaps 87 are folded along a pair of vertical fold lines 88 so that the flaps 87 are perpendicular to the bottom portion 12, and then the bottom portion 12 is folded along a horizontal fold line 89 so that the flaps 87 are disposed adjacent the side walls 18. Then, each of the side portions of the sheet 70 is successively folded along a pair of parallel fold lines 90, 92 to form the interior side walls 22 and the front faces 44, and a pair of tabs 94 on each interior side wall 22 are inserted into a pair of respective slots 96 formed in the back wall 16 to maintain the position of the interior side walls 22. When so folded, each of the flaps 87 is disposed between a respective pair of the side walls 18, 22.

Next, a pair of small flaps 106 are folded along a pair of short fold lines 108, and then the outer portion of the display package 10 is completed by folding the bottom portion of the sheet 70 around the flaps 106 by making successive folds along four fold lines 110, 112, 114, 116 and inserting two tabs 120 into two respective slots 122. The slots 122 are long enough to accommodate both the tabs 120 and a pair of tabs 124 on the flaps 106. When so folded, a sheet portion 126 lies over the bottom portion 12 of the display package 10.

Referring to FIG. 3, the internal support structure 20 of the display package 10 is adapted to support a number of different types of computer accessories. The support structure 20 includes a central support member 130 having a front face 132, a top face 134, and two side faces 136. The front face 132 has an angled, hexahedral shaped cavity 140 and a pair of vertically disposed slots 142 formed therein. The front face 132 also has a U-shaped slot 144 formed therein and a member 146 having two tabs 148.

A pair of angled, side support members 150 are disposed on either side of the central support member 130. Each of the side support members 150 has a angled face 152, an upper face 154, an upper tab 156, and a lower tab 158. The upper and lower tabs 156, 158 are disposed within a pair of respective slots 160, 162 (see FIG. 5) formed in the internal side walls 22 of the display package 10.

Figure 4:
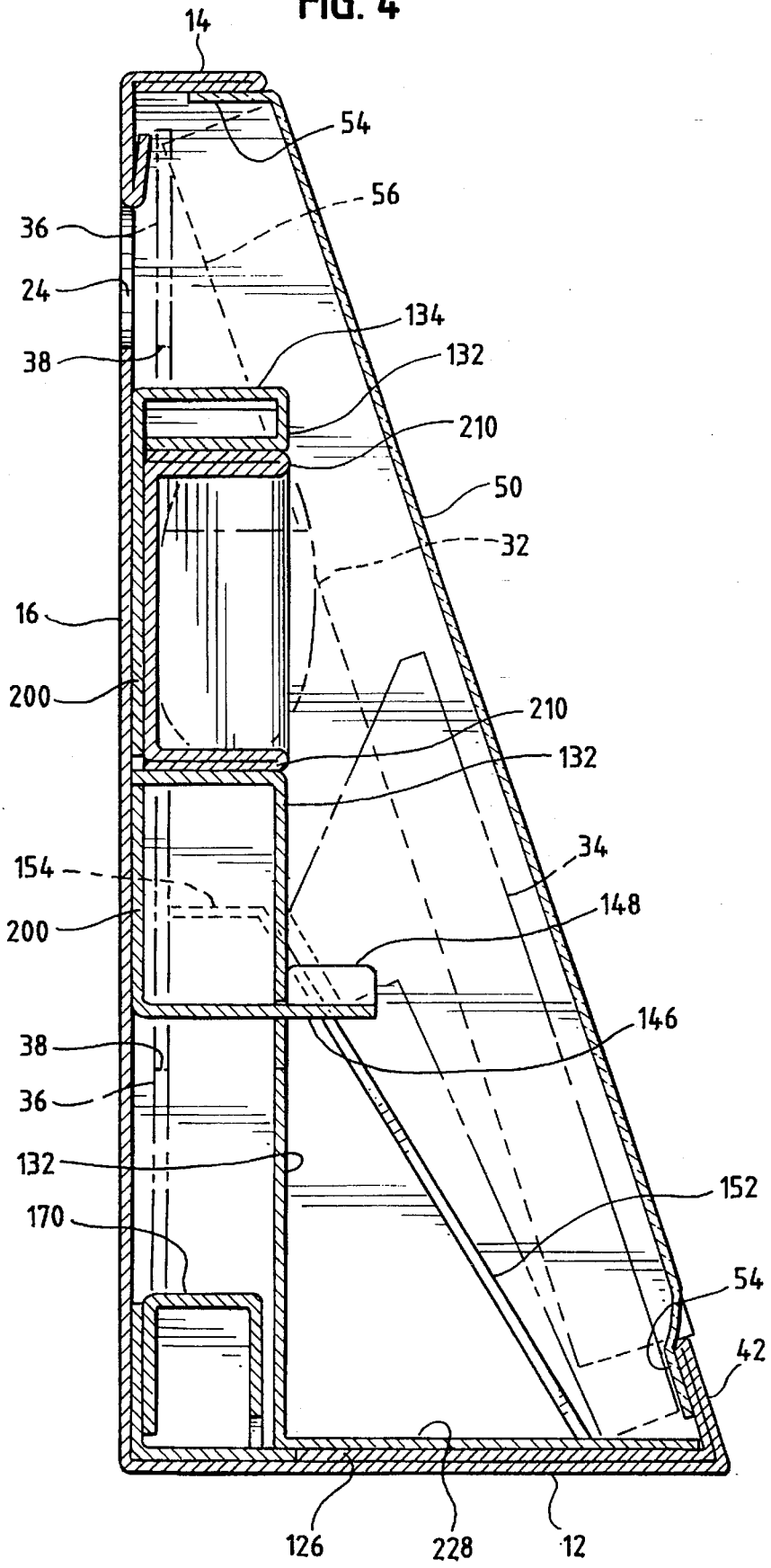
FIG. 4 is a side view of the display package taken along the lines 4—4 in FIG. 3.

As shown in FIG. 4, a tubular folded member 170 may be disposed at the rear bottom corner of the display package 10. The tubular member 170 may have a pair of slots or spaces (not shown) formed in its top and front surfaces, which are aligned with the slots 142 in the central support member 130, and the arms of the disk holder may also be disposed within the slots formed in the member 170. The tubular member 170, which may be sized to partially support the bottom edge of the computer monitor mask 36, is not considered to be a necessary part of the internal support structure 20 since that support structure 20 may support all of the computer accessories described above without the tubular member 170.

When the computer accessories described above are disposed within the display package 10, the central support member 130 is disposed within the rectangular central aperture 38 of the computer monitor mask 36, and the mouse 32 is supported within the hexahedral cavity 140 formed in the central support member 130. The vertical arms of the disk holder (not shown) are disposed within the slots 142 formed in the central support member 130. Depending on the shape of the bottom side of the keyboard 34, the keyboard 34 may rest against the angled faces 152 of the side support members 150 and/or the extending member 146. The mouse pad (not shown) may be disposed between the central support member 130 and the keyboard 34.

Figure 6:
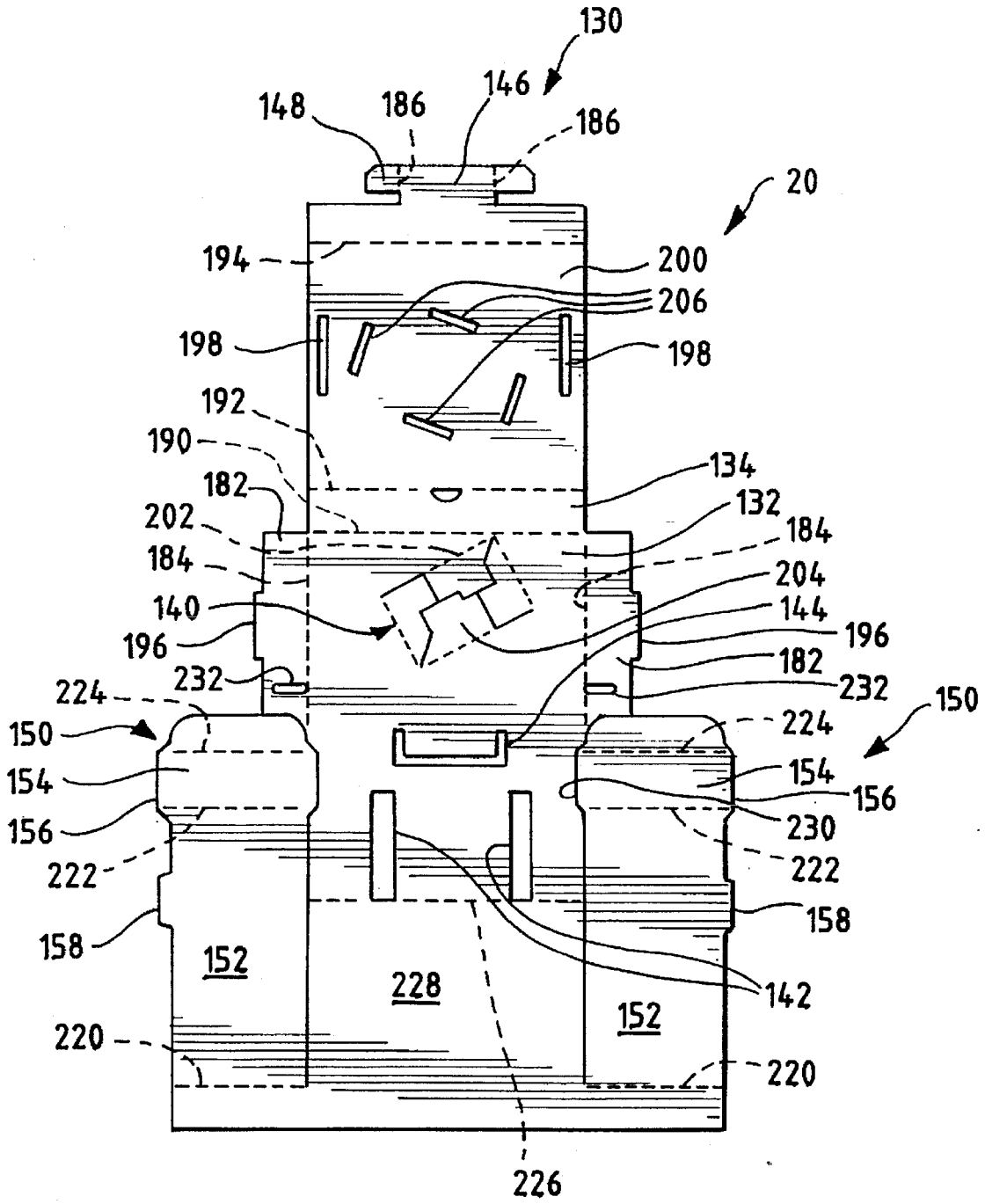
FIG. 6 illustrates a cardboard blank from which the internal support structure of the display package may be formed.

The internal support structure 20 of the display package 10 may be formed from a single sheet of double-faced corrugated cardboard as shown in FIG. 6, in which fold lines are indicated by dotted lines and boundaries or cuts are indicated by solid lines. Referring to FIG. 6, to form the internal support structure 20, a pair of side flaps 182 are folded downwardly along a pair of vertical fold lines 184 so that they are perpendicular to the face 132. Then, the extending member 146 is folded along a pair of short fold lines 186 to form the tabs 148 and so that the shape of the member 146 conforms to the U-shaped form of the slot 144. Then, the upper portion of the sheet 20 is folded successively along three horizontal fold lines 190, 192, 194, and the member 146 is inserted into the U-shaped slot 144 and a pair of tabs 196 on the side flaps 182 are inserted into a pair of respective slots 198 formed in a sheet portion 200. The tabs 148 are then folded slightly outward (see FIG. 3) so that the above folds are maintained. Then the angled, hexahedral cavity 140 is formed by making four folds along four fold lines 202 to form four tabs 204 and then forcing the ends of those tabs 204 into four respective angled slots 206 formed in the sheet portion 200. As shown in FIG. 4, a U-shaped cardboard member 210 may be inserted into the angled cavity 140 after the above folds are made and prior to the insertion of the computer mouse 32.

The internal support structure 20 is completed by making three folds in each of the side support members 150 along three horizontal fold lines 220, 222, 224 and another fold along a fold line 226. When the folded support structure 20 is inserted into the outer portion of the display package 10, a bottom sheet portion 228 is disposed flat against the bottom 12 of the display package 10, the tabs 156, 158 of the side support members 150 are disposed within the slots 160, 162 in the internal side walls 22, and a pair of tabs 230 of the side support members 150 are disposed within a pair of slots 232 formed in the side flaps 182.

To assemble the display package 10, the outer portion is first formed as described above in connection with FIG. 5. The tubular member 170 is then inserted into the rear bottom corner of the display package 10, and the computer monitor mask 36 is then placed in the back of the display package 10 to rest on top of the tubular support member 170. Then the internal support structure 20 is formed as described above in connection with FIG. 6 and then placed within the display package 10. An adhesive may be applied to the sheet portion 200 (see FIG. 6) to adhere the internal support structure 20 to the back wall 16 of the display package 10. After the support structure 20 is added, the computer mouse 32 is inserted into the cavity 140, the disk holder is inserted into the slots 142 in the central support member 130, the mouse pad is placed within the package 10, and then the keyboard 34 is leaned against the angled side support members 150. After all the accessories are added, the display package 10 is sealed with the transparent overlay 50.

After the display package 10 is sold, the purchaser can remove the overlay 50, as shown in FIG. 2, by inserting a finger into each hole 64 in the overlay 50 and pulling the overlay 50 downwards, in which case it will tear or separate along the vertical lines 60 (see FIG. 3), so that the side portions 56 of the overlay 50 remain adhered to the sides 18 of the display package 10.

The display package 10 and the computer accessories disposed therein may be designed in accordance with a number of themes intended to be entertaining to children, such as a Flintstones theme or a Nickelodeon theme. For example, where the display package and the computer accessories are designed in accordance with a Flintstones theme, the transparent overlay 50, the outer portions of the display package 10, and the computer monitor mask 36 may have Flintstones scenes or characters formed thereon, and the computer accessories may also be designed in accordance with that theme.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A display package for the display of a plurality of different types of computer accessories, said display package comprising:

a container having a bottom portion, a back wall, a top portion, and a pair of side walls functionally interconnecting said bottom portion, said top portion, and said back wall, said top portion, said bottom portion, said back wall, and said side walls defining a partially enclosed space, said top portion having a width and said bottom portion having a width, said width of said top portion being smaller than said width of said bottom portion, each of said side walls having a non-constant width which decreases from a first width to a second width, said first width of said side walls being substantially the same as said width of said bottom portion and said second width of said side walls being substantially the same as said width of said top portion; and a unitary support structure disposed within said partially enclosed space for supporting a plurality of computer accessories, said unitary support structure comprising:

a first structure adapted to support a first type of computer accessory having a first shape;

a second structure adapted to support a second type of computer accessory having a second shape different from said first shape, said second structure being integrally formed with said first structure; and a third structure adapted to support a third type of computer accessory having a third shape different from said first and second shapes, said third structure being integrally formed with said first and second structures.

2. A display package as defined in claim 1 wherein said first structure comprises means for supporting a computer mouse.

3. A display package as defined in claim 2 wherein said means for supporting said computer mouse comprises a hexahedral cavity disposed in said unitary support structure.

4. A display package as defined in claim 1 wherein said second structure comprises means for supporting a computer disk holder.

5. A display package as defined in claim 4 wherein said means for supporting a computer disk holder comprises a pair of slots in said unitary support structure, said slots being substantially parallel to each other.

6. A display package as defined in claim 1 wherein said third structure comprises means for supporting a computer keyboard.

7. A display package as defined in claim 6 wherein said means for supporting said computer keyboard comprises a pair of angled walls which extend from said bottom portion.

8. A display package as defined in claim 1 additionally comprising a transparent overlay which fully encloses said partially enclosed space.

9. A display package for the display of a plurality of different types of computer accessories, said display package comprising:

a container having a bottom portion, a back wall, a top portion, and a pair of side walls functionally interconnecting said bottom portion, said top portion, and said back wall, said top portion, said bottom portion, said back wall, and said side walls defining a partially enclosed space, said top portion having a width and said bottom portion having a width, said width of said top portion being smaller than said width of said bottom portion; and an internal support structure disposed within said partially enclosed space for supporting a plurality of computer accessories, said internal support structure comprising:

a first structure adapted to support a first type of computer accessory having a first shape;

a second structure adapted to support a second type of computer accessory having a second shape different from said first shape; and a third structure adapted to support a third type of computer accessory having a third shape different from said first and second shapes.

10. A display package as defined in claim 1 wherein said first structure comprises means for supporting a computer mouse.

11. A display package as defined in claim 10 wherein said means for supporting said computer mouse comprises a hexahedral cavity disposed in said unitary support structure.

12. A display package as defined in claim 1 wherein said second structure comprises means for supporting a computer disk holder.

13. A display package as defined in claim 12 wherein said means for supporting a computer disk holder comprises a pair of slots in said unitary support structure, said slots being substantially parallel to each other.

14. A display package as defined in claim 1 wherein said third structure comprises means for supporting a computer keyboard.

15. A display package as defined in claim 14 wherein said means for supporting said computer keyboard comprises a pair of angled walls which extend from said bottom portion.

16. A display package as defined in claim 9 additionally comprising a transparent overlay which fully encloses said partially enclosed space.

17. A display package for the display of a plurality of different types of products, said display package comprising:

a container having a bottom portion, a back wall, a top portion, and a pair of side walls functionally interconnecting said bottom portion, said top portion, and said back wall, said top portion, said bottom portion, said back wall, and said side walls defining a partially enclosed space; and a unitary internal support structure disposed within said partially enclosed space for supporting a plurality of products, said internal support structure comprising:

a central portion adapted to support a first type of product having a first configuration; and at least one side portion integrally formed with said central portion, said side portion being adapted to support a second type of product having a second configuration different from said first configuration.

18. A display package as defined in claim 17 additionally comprising a second side portion integrally formed with said central portion.

19. A display package as defined in claim 18 wherein each of said side portions integrally formed with said central portion comprises an angled sheet portion.

20. A display package as defined in claim 17 additionally comprising a transparent overlay which fully encloses said partially enclosed space.

* * * * *